US009719238B2

(12) United States Patent
Momoe et al.

(10) Patent No.: US 9,719,238 B2
(45) Date of Patent: Aug. 1, 2017

(54) OPERATING DEVICE FOR FLUSH WATER TANK DEVICE

(71) Applicant: TOTO LTD., Fukuoka (JP)

(72) Inventors: Masaaki Momoe, Kitakyushu (JP); Takashi Oogami, Kitakyushu (JP); Masateru Shiraishi, Kitakyushu (JP); Hiroshi Suminaka, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 151 days.

(21) Appl. No.: 14/660,112

(22) Filed: Mar. 17, 2015

(65) Prior Publication Data

US 2015/0275492 A1 Oct. 1, 2015

(30) Foreign Application Priority Data

Mar. 31, 2014 (JP) ..... 2014-073801

(51) Int. Cl.
*E03D 5/10* (2006.01)
*E03D 5/09* (2006.01)
*E03D 5/094* (2006.01)

(52) U.S. Cl.
CPC ..... *E03D 5/10* (2013.01); *E03D 5/09* (2013.01); *E03D 5/094* (2013.01)

(58) Field of Classification Search
CPC ..... E03D 5/09; E03D 5/094; E03D 5/10
USPC ..... 4/406
See application file for complete search history.

(56) References Cited

U.S. PATENT DOCUMENTS

2004/0154087 A1* 8/2004 Hogues, Jr. ..... E03D 5/10 4/405
2005/0076425 A1* 4/2005 Contadini ..... E03D 5/10 4/405
2015/0275491 A1* 10/2015 Shinohara ..... E03D 5/094 4/325

FOREIGN PATENT DOCUMENTS

CN 2641156 Y 9/2004

* cited by examiner

*Primary Examiner* — Tuan N Nguyen
(74) *Attorney, Agent, or Firm* — Studebaker & Brackett PC

(57) ABSTRACT

The present invention relates to an operating device for a flush water tank device in a flush toilet wherein manual and motorized control units are configured to actuate a flush valve by means of a single connecting member operably connecting the manual and motorized control units to the flush valve. The operating device is characterized by a single connecting member operatively connected to the flush valve for opening and closing the flush valve depending on a pull-up amount of the connecting member, a manually operating unit for pulling up the single connecting member when a user performs a manual operation for the control unit, and an electrical drive unit adapted to pull up the single connecting member so as to actuate the flush valve by using an electrical power from an external power source.

10 Claims, 6 Drawing Sheets

OPERATING DEVICE FOR FLUSH WATER TANK DEVICE

TECHNICAL FIELD

The present invention relates to an operating device, and more particularly, to an operating device for a flush water tank device adapted to actuate a flush valve disposed in a flush water tank so as to initiate delivery of flush water to a toilet main unit.

BACKGROUND ART

As an operating device for controlling flushing of a toilet main unit by actuating a flush valve adapted to open and close a water discharge port of a water reservoir tank flush water tank storing a volume of flush water to be delivered, there has been known an operating device with a wire connection comprising an operating lever adapted to be merely manually operated by a user for rotation, a drive device having a driving shaft operatively connected to the manual lever and adapted to be manually rotated by the user, and a wire member connecting the drive device and a flush valve adapted to open and close a water discharge port of a flush water tank and adapted to pull up the flush valve via the rotation of the driving shaft of the drive device, as disclose in Patent Document No. 1 (CN-U 2641156A).

SUMMARY OF INVENTION

Technical Problem

As described above, the conventional operating device for the flush valve of the flush water tank device depends on the manual type of operating lever. Recently, there has been an increasing demand to provide an automated (motorized) operating device with a wire connection in favor of an improved ease-to-use. That is to say, a user's demand is made to utilize the operating device for the flush valve either manually or automatically. Thus, it is required to provide a modified operating device with wire connection comprising both manual and motorized control units.

To this end, it is necessary to provide two separate wires operatively connecting the manual and motorized control units, respectively, to the single flush valve for independently controlling the actuation of the flush valve by means of either manual or automatic operation. As a matter of practice, it may prove difficult to retrofit such approach to the existing operating device for the flush water tank device to provide the operating device comprising both the manual and motorized control units.

Thus, the present invention seeks to eliminate the problems in the prior art as described above and to propose a novel operating device for a flush water tank device wherein manual and motorized control units are configured to actuate a flush valve by means of a single connecting member operably connecting the manual and motorized control units to the flush valve.

Solution to Problem

In order to achieve the above object, according to a first aspect of the present invention, there is provided an operating device for a flush water tank device adapted to actuate a flush valve disposed in a flush water tank so as to initiate delivery of flush water to a toilet main unit, comprising: a single connecting member operatively connected to the flush valve for opening and closing the flush valve depending on a travel amount (pull-up and pull-down amount) of the connecting member; a manually operating unit provided on the flush water tank for pulling up the single connecting member when a user performs a manual operation for the control unit; and an electrical drive unit adapted to pull up the single connecting member so as to actuate the flush valve by using an electrical power from an external power source.

With such arrangement of the present invention, each of the manually operating unit and the electrical drive unit (that is, either of the manually operating unit and the electrical drive unit) can actuate the flush valve through the single connecting member. In the operating device of the flush water tank device utilizing the single connection member, the flush valve not only can actuated when the user performs a manual rotational operation, but also can actuated by means of the electrical power of the external power source. Thus, an improved ease-to-use for the user with respect to the operating device of the flush water tank device can provided.

In accordance with the present invention, preferably, the single connecting member is connected at its one end to the flush valve to operate and close depending on the pull-up and pull-down amount (travel distance) of the connecting member; the manually operating unit on the flush water tank is operatively connected to the other end of the single connecting member such that the manually operating unit can pull up the single connecting member as the user performs the manual operation for the manually operating unit to thereby actuate the flush valve; and the electrical drive unit comprises a rotating mechanism adapted to be rotated freely with the single connecting member being along an outer periphery of the rotating mechanism and an electrical drive for moving the rotating mechanism by using an electrical power from an external power source, the movement of the rotating mechanism causing the single connecting member to be pulled up to actuate the flush valve.

With such arrangement of the present invention, preferably, the manually operating unit can pull up the connecting member to actuate the flush valve when the user performs the manual rotational operation. Also, the electrical drive unit can pull up the connecting member to actuate the flush valve by using an electrical power from an external power source.

Thus, either of the manually operating unit and the electrical drive unit can actuate the flush valve through the single connecting member. The flush valve not only can be actuated when the user performs a manual rotational operation, but also can be actuated by means of the electrical power of the external power source. Thus, an improved ease-to-use for the user with respect to the operating device of the flush water tank device can provided.

In accordance with the present invention, preferably, the electrical drive of the electrical drive unit comprises a motor part for driving a rotary shaft of the motor part and an arm member having one of ends connected to the rotary shaft of the motor part and the other end connected to the rotating mechanism, the rotation of the rotary shaft of the motor part causing the arm member to rotate about the rotary shaft to thereby providing the movement of the rotating mechanism.

With such arrangement of the present invention, the electrical drive of the electrical drive unit can move the rotating mechanism by means of a relatively simple structure.

In accordance with the present invention, preferably, the control unit further comprises tubular members extending between the manual control and the electrical drive unit and between the electrical drive unit and the flush valve, respectively and each having an interior passage through which the single connecting member extends from the manually operating unit through the electrical drive unit to the flush valve; the tubular members being connected at their respective opposite ends to the electrical drive unit with the single connecting member being exposed between the respective opposite ends of the tubular members within the electrical drive unit, the movement of the rotating mechanism causing the single connecting member to be pulled out of the respective interior passages of the tubular members into the interior of the electrical drive unit to thereby pull up the single connecting member.

With such arrangement of the present invention, the connecting member can be pulled up along the configuration of the tubular members between the electrical drive unit, the manually operating unit and the flush valve. Therefore, it is not required to make the connecting member stretched in taut between the electrical drive unit, the flush valve and the manually operating unit. Accordingly, the electrical drive unit can be positioned in an unconstrained manner within the flush water tank by comparison with the arrangement in which no tubular member is disposed.

In accordance with the present invention, preferably, the electrical drive unit further comprises tube holding portions holding respective one end of the respective first and second tubular members.

With such arrangement of the present invention, in view of the fact that the tube holding portions holds respective one end of the tubular members, when the rotating mechanism is moved, the connecting member can pulled out of the tubular members into the interior of the electrical drive unit to control the pull-out amount of the connecting member to a preset level dependent on the movement of the rotating mechanism. Accordingly, the pull-up amount of the flush valve can be controlled relatively exactly to reduce variation in the pull-up amount of the flush valve.

In accordance with the present invention, preferably, the tube holding portions of the electrical drive unit holds the respective one ends of the tubular members so that the direction of movement of the rotating mechanism substantially corresponds to the direction in which the single connecting member is pull out of the respective interior passages of the tubular members into the interior of the electrical drive unit to thereby pull up the single connecting member.

With such arrangement of the present invention, the pull-up amount of the connecting member relative to the upward movement of the rotating mechanism can be substantially maximized. When the rotating mechanism is moved, the connecting member can be effectively pulled out of the interior of tubular member into the interior of the electrical drive unit.

In accordance with the present invention, preferably, the electrical drive of the electrical drive unit is positioned above a full level of water pooled within the flush water tank.

With such arrangement of the present invention, the electrical drive can be protected against failure due to a possible ingress of the water into the electrical device. Accordingly, the electrical drive unit can appropriately pull up the connecting member to actuate the flush valve.

In accordance with the present invention, preferably, the electrical drive unit can change an angle of rotation of the arm member between a first angle of rotation and a second angle of rotation which is smaller than the first angle of rotation so as to change the pull-up amount of the connecting member between a pull-up amount of the flush valve of a large-scale flushing mode and a pull-up amount of the flush valve of a small-scale flushing mode of the flush water tank device.

With such arrangement of the present invention, the electrical drive unit can change the angle of rotation of the arm member between the first angle of rotation and the second angle of rotation which is smaller than the first angle of rotation to change the movement of the rotating mechanism and also the pull-up amount of the connecting member. As a result, the pull-up amount of the connecting member can be changed between the pull-up amount of the flush valve in the large-scale flushing mode and the pull-up amount of the flush valve in the small-scale flushing mode. Consequently, the electrical drive unit can change between the large-scale flushing mode and the small-scale flushing mode.

Also, the present invention provides a flush water tank device including an operating device as defined above.

With such arrangement of the present invention, there can be provided a flush water tank device in which either of the manually operating unit and the electrical drive unit can actuate the flush valve through the single connecting member.

Further, the present invention provides a flush toilet equipped with a flush water tank device as defined above.

With such arrangement of the present invention, there can be provided a flush toilet comprising flush water tank device in which either of the manually operating unit and the electrical drive unit can actuate the flush valve through the single connecting member.

Advantageous Effects of Invention

In the operating device for a flush water tank device according to the present invention, manual and motorized control units are configured to actuate a flush valve by means of a single connecting member.

DESCRIPTION OF EMBODIMENTS

With reference to the accompanying drawings, an operating device of a flush water tank device according to the first embodiment of the present invention will be described hereinafter.

Firstly, with reference to FIG. 1, a flush toilet equipped with a flush water tank device including an operating device according to the first embodiment of the present invention will be described below.

Figure 1:
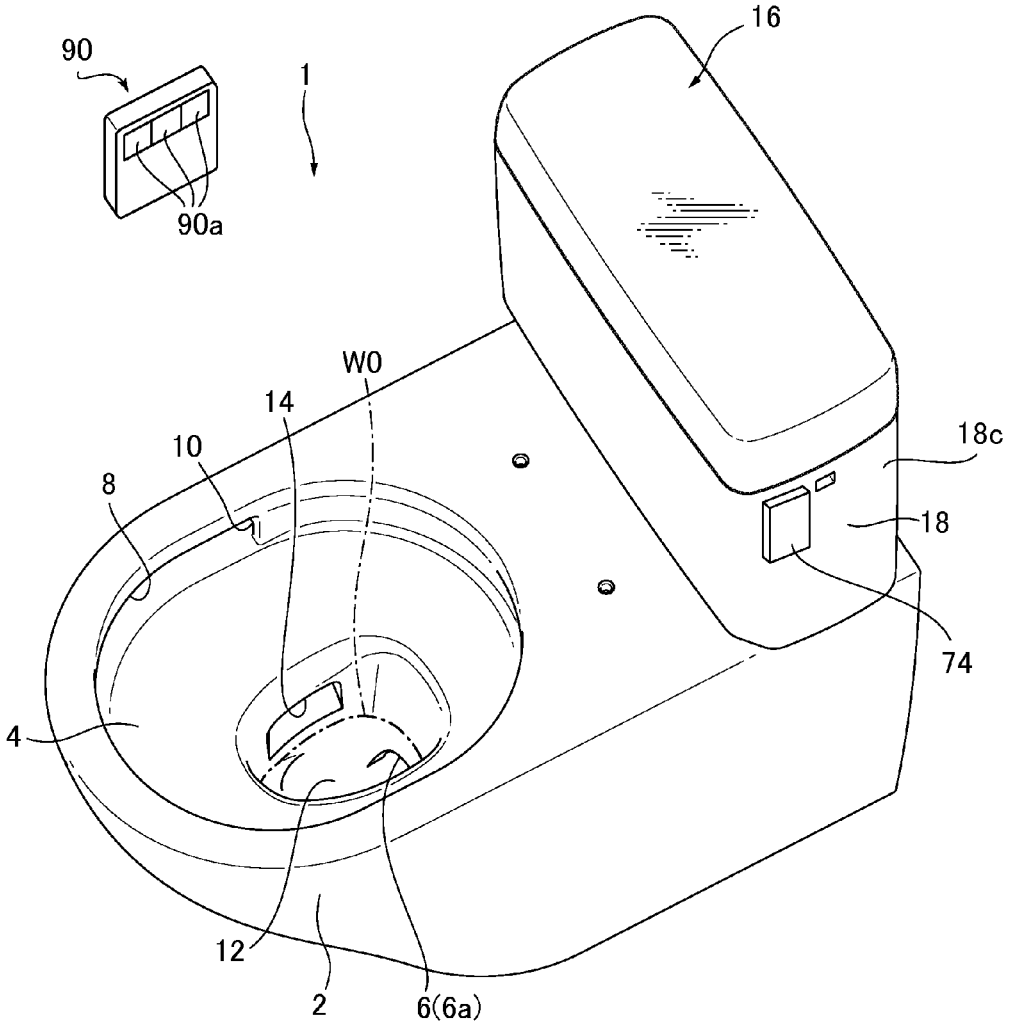
FIG. 1 is a top perspective view of a flush toilet equipped with a flush water tank device including an operating device according to the first embodiment of the present invention with its toilet seat and lid removed.

FIG. 1 is a perspective view illustrating a flush toilet equipped with a flush water tank device including water discharge valve device according to the first embodiment of the present invention with a toilet seat and a toilet lid removed and a cover of the flush water tank device attached.

As can be seen from FIG. 1, reference numeral 1 denotes a so-called siphon-type flush toilet wherein the human waste in the bowl can be sucked and at once expelled outwardly through a drainage trap conduit or trapway under siphon action. This flush toilet 1 comprises a toilet main unit 2 made of porcelain. The toilet main unit 2 is provided with a bowl 4 and a wastewater trap conduit 6 placed in fluid communication with the lower part of the bowl 4.

The top edge part of the bowl 4 of the toilet main unit 2 comprises an inwardly overhanging rim 8 and a first discharge port 10 discharging a flush water supplied from a water conduit (not shown) which is formed in the interior of the backward portion of the toilet main unit 2. The flush water discharged from the first discharge port 10 cleans the surface of the bowl 4 while flowing spirally and downwardly.

The bowl 4 is formed at its bottom with a water pooling region 12, its pooled water level being shown by a dash-single dot line W0. The wastewater trap conduit 6 has an inlet 6*a* fluidly connected to the bottom of the water pooling region 12. The opposite end of the wastewater trap conduit 6 to the inlet 6*a* is connected to an underfloor exhaust pipe (not shown) through a wastewater exhaust socket (not shown).

The bowl 4 is further formed at a position above the pooled water level W0 with a second discharge port 14 which discharges a flush water supplied from a water conduit (not shown) which is formed in the interior of the backward portion of the toilet main unit 2. The flush water discharged from the second discharge port 14 is adapted to create a swirl flow which can swirl the pool of water in the water pooling region 12 in the vertical direction.

Atop the backward part of the toilet main unit 2 is disposed a flush water tank device 16 which stores the flush water supplied or discharged to the toilet main unit 2.

Although the first embodiment has been described in connection with the flush water tank device 16 applied to the siphon-type flush toilet, the features of the first embodiment may be equally applicable to other types of flush toilets such as a so-called wash-down type flush toilets to design to be emptied of waste under a water flow action caused by the water drop in the bowl.

Figure 2:
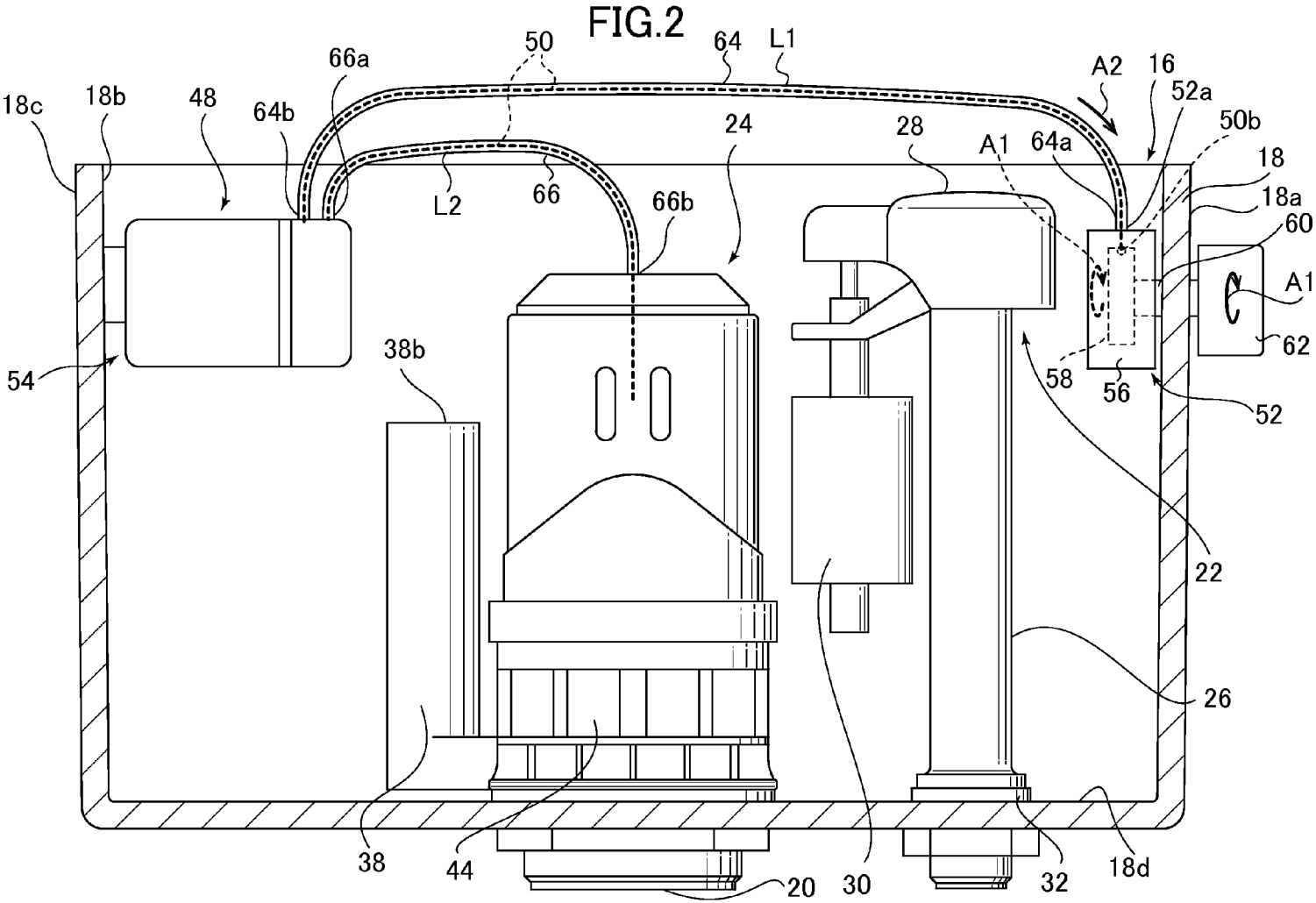
FIG. 2 is a front cutaway perspective view of a flush toilet equipped with a flush water tank device including an operating device according to the first embodiment of the present invention for illustrating the details of the internal structure of the flush water tank device.
Figure 3:
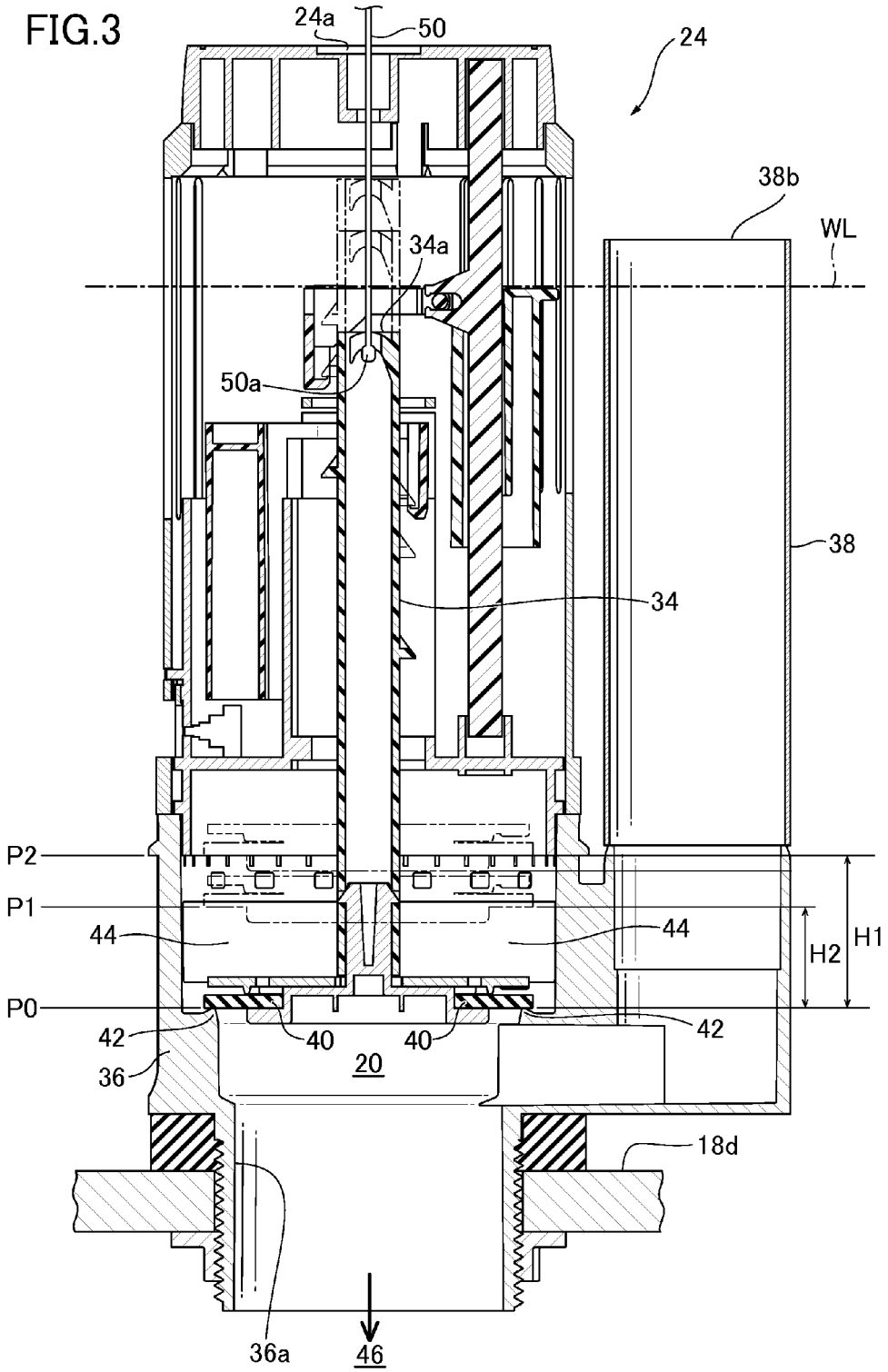
FIG. 3 is a sectional view of a water discharge valve device as shown in FIG. 2 along its longitudinally central line, showing the state of the water discharge valve device according to the first embodiment of the present invention before started in small-scale and large-scale flushing modes.

With reference to FIGS. 2 and 3, the details of the internal structure of the flush water tank device 16 will now be described.

FIG. 2 is a front cutaway perspective view of a flush water tank device including an operating device according to the first embodiment of the present invention, illustrating the details of the internal structure of the flush water tank device. FIG. 3 is a sectional view of a water discharge valve device as shown in FIG. 2 along its longitudinally central line, showing the state of the water discharge valve device according to the first embodiment of the present invention before started in small-scale and large-scale flushing modes.

As shown in FIG. 2, the flush water tank device 16 comprises a flush water tank 18 for storing the flush water used to flush the flush toilet 1. The flush water tank 18 is provided at its bottom 18*d* with a water discharge port 20 leading to a water conduit (not shown) of the toilet main unit 2, such that the flush water can be supplied from the flush water tank 18 to the water conduit (not shown) of the toilet main unit 2. An amount of flush water to be stored in the flush water tank 18 varies depending on types of toilets. The flush water tank 18 is one of a low-silhouette type, for example, but may be other than a low-silhouette type of flush water tank.

As can be seen in FIG. 2, the flush water tank 18 of the flush water tank device 16 receives a water supply device 22 for delivering the flush water into the flush water tank 18 and a water discharge valve device 24 for controlling a drainage or water discharge port 20 such that the flush water stored in the flush water tank 18 can be caused to flow into the water conduit (not shown) of the toilet main unit 2.

The water supply device 22 comprises a water supply pipe 26 connected to an external source of water supply (not shown) and extending upwardly from the bottom 18*d* of the flush water tank 18, a feed valve 34 attached to the top end of the water supply pipe 26 for switching between delivery and stop of the flush water flow from the water supply pipe 26 into the flush water tank 18, and a float 30 adapted to move upwardly and downwardly depending on the level of water within the flush water tank 18 for switching between the delivery and stop of the flush water via the feed valve 28.

The water supply pipe 26 is provided at its bottom end with a water outlet 32 placed in fluid communication with the interior of the flush water tank 18 such that the flush water from the feed valve 28 is delivered into the flush water tank 18 through the water outlet 32.

The float 30 in the water supply device 22 downwardly moves with the level of the flush water being lowered when the flush water is discharged from the interior of the flush water tank 18 into the toilet bowl through the water discharge valve device 24, the recitation of which will be described later. In this manner, the feed valve 28 is opened to start the discharge of flush water from the water outlet 32 such that the flush water is discharged from the external source of water supply (not shown) into the flush water tank 18 of the flush water tank device 16.

As the flushing is continued and the level of water within the flush water tank 18 increases, the float 30 upwardly moves to close the feed valve 28, thereby interrupting the delivery of flush water from the water outlet 32. In such a manner, the level of flush water within the flush water tank 18 can be maintained in a predetermined full level WL.

FIG. 3 is a central cross-sectional view of the water discharge valve device shown in FIG. 2. As can be best seen in FIGS. 2 and 3, the water discharge valve device 24 is a direct acting type water discharge valve device comprising a valve stem 34 which can be moved upwardly and downwardly to open and close the water discharge port 20. The top end 34*a* of the valve stem 34 is connected to one end 50*a* of a wire member 50 adjacent to the flush valve, the details of the structure of the wire member being described below.

The other end of the wire member 50 is connected to a manually operating unit via an electrical drive unit in the operating device of the flush water tank device. In such a manner, the manually operating unit or electrical drive unit can be used to pull up a single common wire member 50. As a result, the valve stem 34 is upwardly moved to open the water discharge port 20 such that the flush water in the flush water tank 18 flows into the water conduit (not shown) of the toilet main unit 2. Consequently, the flushing of the toilet bowl will be started.

Also, as can be seen FIGS. 2 and 3, the flush or drainage opening 20 is defined, more particularly, by the whole section of a drainage line 36*a* which extends downwardly substantially from the central portion of a water discharge port forming member 36 which is attached to the bottom 18*d* of the flush water tank 18. The top edge of the drainage line 36*a* is provided with a valve seat 42 extending around the whole circumference of the drainage line 36*a*. As shown in FIG. 3, the valve stem 34 is provided at its bottom end with a valve body 40 mounted thereon to close the water discharge port 20 when the valve stem 34 is downwardly moved and engaged by the valve seat 42. As can be seen in FIGS. 2 and 3, additionally, the water discharge port forming member 36 comprises a plurality of communicating ports 58 for conducting the flush water outside of the water discharge valve device 24 into the water discharge port 20.

As shown in FIG. 3, at its interior the water discharge valve device 24 comprises a variety of associated elements for adjusting a timing at which the valve stem 34 is controlled in the respect one of the large-scale and small-scale flushing modes. These associated elements will not be further described since the control of the valve stem 34 through the wire member can be ensured at the minimal level even if they have been omitted.

In FIG. 3, the valve stem 34 and the valve body 40 of the water discharge valve device 24 are shown by solid line when the valve body 40 is engaged by the valve seat in a valve closing position P0 and are shown by chain-dotted line respectively when the valve body 40 is moved to the maximum valve opening position P1 in the small-scale flushing mode and to the maximum valve opening position R2 in the large-scale flushing mode.

In the valve opening position of the water discharge valve device 24 in the large-scale flushing mode, as shown in FIGS. 2 and 3, the manually operating unit 52 or the electrical drive unit 54 is actuated to pull the wire member 50 up to a predetermined maximum and at the same time, the valve body 40 of the valve stem 34 is moved upwardly from the valve closing position P0 to the valve opening position P2 to open the water discharge port 20. At this time, the upper height (stroke) H of the valve body 40 relative to the valve seat 42 is the maximum height (maximum stroke) H1 which is higher than the upper height H2 in the small-scale flushing mode (H1>H2). As a result, the relatively much amount of the flush water is delivered to the water conduit 46 of the toilet main unit 2 of the flush toilet 1. Therefore, the flushing of the toilet bowl is started in the large-scale flushing mode.

On the other hand, in the valve opening position of the water discharge valve device 24 in the small-scale flushing mode as shown in FIGS. 2 and 3, the manually operating unit or the electrical drive unit is actuated to pull the wire member 50 to a pull-up amount which is less than the maximum pull-up amount of the wire member 50 in the large-scale flushing mode. At the same time, the valve body 40 of the valve stem 34 is moved upwardly from the valve closing position P0 to the highest valve opening position P1 in the small-scale flushing mode which is lower than the highest valve opening position P2 in the large-scale flushing mode. As a result, the water discharge port 20 is opened. At this time, the upper height (stroke) H of the valve body 40 relative to the valve seat 42 is equal to a height H2 lower than the maximum stroke H1 in the large-scale flushing mode. As a result, the amount of flush water smaller than that of the large-scale flushing mode is delivered from the flush water tank 18 to the water conduit 46 of the toilet main unit 2 of the flush toilet 1. Therefore, the flushing of the toilet bowl is started in the small-scale flushing mode.

As can been seen in FIG. 3, the valve stem 34 of the water discharge valve device 24 is adapted to move downwardly while performing a predetermined operation as the water level is lowered, after the valve body 40 has been moved upwardly by the wire member together with the valve stem 34 depending on the pull-up amount in the respective one of the large-scale and small-scale flushing modes. As shown in FIG. 3, if the valve body 40 is engaged by the valve seat 42 at its valve closing position P0 or its stand-by position (start position), the water discharge port 20 is closed. This terminates the drainage of the water discharge valve device 24 in the large-scale or small-scale flushing mode. Thereafter, the flush water tank 18 is filled with the flush water from the water supply device 22 to the full level WL.

Should the level in the flush water tank 18 exceeds the full level WL and then reach the level of the open top 38*b* of an overflow pipe 38 which is higher than the full level WL, the flush water flows into the open top 38*b* of the overflow pipe 38 to flow toward the toilet main unit 2 through the water discharge port 20 of the flush water tank 18.

With reference to FIGS. 2 to 6, an operating device for a flush water tank device according to the first embodiment of the present invention will now be described in detail.

The operating device 48 of the flush water tank device 16 is positioned within the flush water tank 18, which operating device 48 is configured to actuate the water discharge valve device 24 and to start the delivery of flush water to the toilet main unit 2.

This operating device 48 comprises a single wire member 50 connected at its one end to the flush valve stem 34 such that the wire member 50 can pull up the valve stem 34 and thus the valve body 40 depending on the pull-up amount of the wire member, a manually operating unit 52 located on the outer left-side wall 18*a* of the flush water tank 18 as viewed from the front of the toilet bowl and configured to manually move the wire member 50 upwardly, an electrical drive unit 54 located on the inner right-side wall 18*b* of the flush water tank 18 and which can be actuated by any source of electric power to move the wire member 50 upwardly, a first tubular member 64 extending between the manually operating unit 52 and the electrical drive unit 54, and a second tubular member 66 extending between the electrical drive unit 54 and the water discharge valve device 24.

The single wire member 50 in the operating device 48 is disposed to connect the manually operating unit 52 to the valve stem 34 through the electrical drive unit 54. The operating device 48 serves as a manually operated washing device actuated by the manually operating unit 52 and also as an automatically operated (motor-operated) washing device actuated by the electrical drive unit 54.

The wire member 50 is connected at its flush valve end 50*a* to the top end 34*a* of the valve stem 34 and at it's the manually operating unit end 50*b* to a rotary wind-up member 58 of the manually operating unit 52.

The manually operating unit 52 comprises the rotary wind-up member 58 which is disposed thin the manually operating unit 52 to form a rotating mechanism unit 56 for the manually operating unit 52 and to which the wire member 50 is at its manually operating unit end 50*b* connected and an operating handle 62 connected to the rotary wind-up member 58 through a rotating shaft member 60 which extends outwardly from the rotating mechanism unit 56 through the flush water tank 18 such that the rotation of the operating handle 62 can be transmitted to the rotary wind-up member 58.

For example, if the operating handle 62 is rotated together with the rotating shaft member 60 in a predetermined direction, the rotary wind-up member 58 of the rotating mechanism unit 56 is rotated to pull up the wire member 50 in the same direction. In the rotating mechanism unit 56, the rotary wind-up member 58 may be connected directly to the rotating shaft member 60. Alternatively, the rotary wind-up member 58 may be connected indirectly to the rotating shaft member 60 via gear means.

The manually operating unit 52 is configured to conduct the large-scale flushing mode if the amount of rotation of the rotary wind-up member 58 (that is, the pull-up amount of the wire member 50 mounted on the rotary wind-up member 58) is relatively great, depending on the direction and/or amount of rotation in the operating handle 62 operated by the user. On the other hand, the manually operating unit 52 conducts the small-scale flushing mode if the amount of rotation in the rotary wind-up member 58 (that is, the pull-up amount of the wire member 50 mounted on the rotary wind-up member 58) is relatively small.

In the illustrated embodiment, the manually operating unit 52 is located on the outer left side 18*a* of the flush water tank 18 as viewed from the front of the toilet bowl. However, the manually operating unit 52 may be located on the outer right side 18*c* of the flush water tank 18 as viewed from the front of the toilet bowl. In the latter case, the operating handle 62 may be mounted on the right side of the flush water tank 18.

The first tubular member 64 is composed of a flexible tube. The first tubular member 64 has a first end 64*a* mounted on a first tube mounting portion 52*a* on the manually operating unit 52, and a second end 64*b* held by a first tube holding portion 86, which will be described later. The first tubular member 64 has a length L1 between the first end 64*a* of the first tubular member and the second end 64*b* of the first tubular member. Thus, the first tubular member 64 may be curvedly disposed within the flush water tank 18. As a result, the wire member 50 of length L1 will be disposed within the first tubular member 64 of length L1.

The first tubular member 64 extends between the manually operating unit 52 and the electrical drive unit 54 and supports therein the wire member 50 movably through the longitudinal passage of the first tubular member 64. Since the wire member 50 is movably supported in the first tubular member 64, the wire member 50 can be pulled up through the curved path in the first tubular member 64. Accordingly, electrical drive unit 54 can be positioned relative to the manually operating unit 52 without any constraints with respect to the location thereof due to the presence of the first tubular member 64.

If there is no first tubular member 64, the wire member 50 must be stretched taut between the manually operating unit 52 and the electrical drive unit 54 such that no slack is created therebetween. Accordingly, the first embodiment of the present invention can overcome the creation of the slack which would otherwise occur. If the wire member 50 is stretched taut between the manually operating unit 52 and the electrical drive unit 54 within the limited space in the flush water tank 18, the manually operating unit 52 and the electrical drive unit 54 must be disposed in line with each other so that they will not interfere with the other instrument. The first embodiment of the present invention can overcome such a problem.

The second tubular member 66 is also defined by a flexible tube. The second tubular member 66 has a first end 66*a* held by a second tubular member holding portion 88 and a second end 66*b* mounted on the top 24*a* of the water discharge valve device 24. The second tubular member 66 has a length L2 between the first end 66*a* of the second tubular member and the second end 66*b* of the second tubular member. Thus, the second tubular member 64 may be curvedly disposed within the flush water tank 18. As a result, the wire member 50 with its length L2 will be disposed within the second tubular member 64 of length L2.

The second tubular member 66 extends between the electrical drive unit 54 and the water discharge valve device 24 and supports therein the wire member 50 movably through the longitudinal and hollow passage of the second tubular member 66. Since the wire member 50 is movably supported in the second tubular member 66, the wire member 50 can be pulled up though the curved passage in the second tubular member 66. Accordingly, the electrical drive unit 54 can be positioned relative to the water discharge valve device 24 without any constraints on the location thereof due to the presence of the second tubular member 66.

If there is no second tubular member 64, the wire member 50 must be stretched taut between the manually operating unit 52 and the water discharge valve device 24 such that no slack is created therebetween. Accordingly, the first embodiment of the present invention can also overcome the creation of the slack which would otherwise occur. If the wire member 50 is stretched taut between the manually operating unit 52 and the water discharge valve device 24 within the limited space in the flush water tank 18, the manually operating unit 52 and the water discharge valve device 24 must be disposed in line with each other so that they will not interfere with the other instrument. The first embodiment of the present invention can overcome such a problem.

The electrical drive unit 54 may be separate from the manually operating unit 52, as in the first embodiment of the present invention. In case where the electrical drive unit 54 and/or the manually operating unit 52 can be disposed without any constrains on their location for the single wire member 50, they can be disposed within the low-silhouette type tank having only its limited space without any difficulties. As a result, both of the electrical drive unit 54 and manually operating unit 52 can be used.

Figure 4:
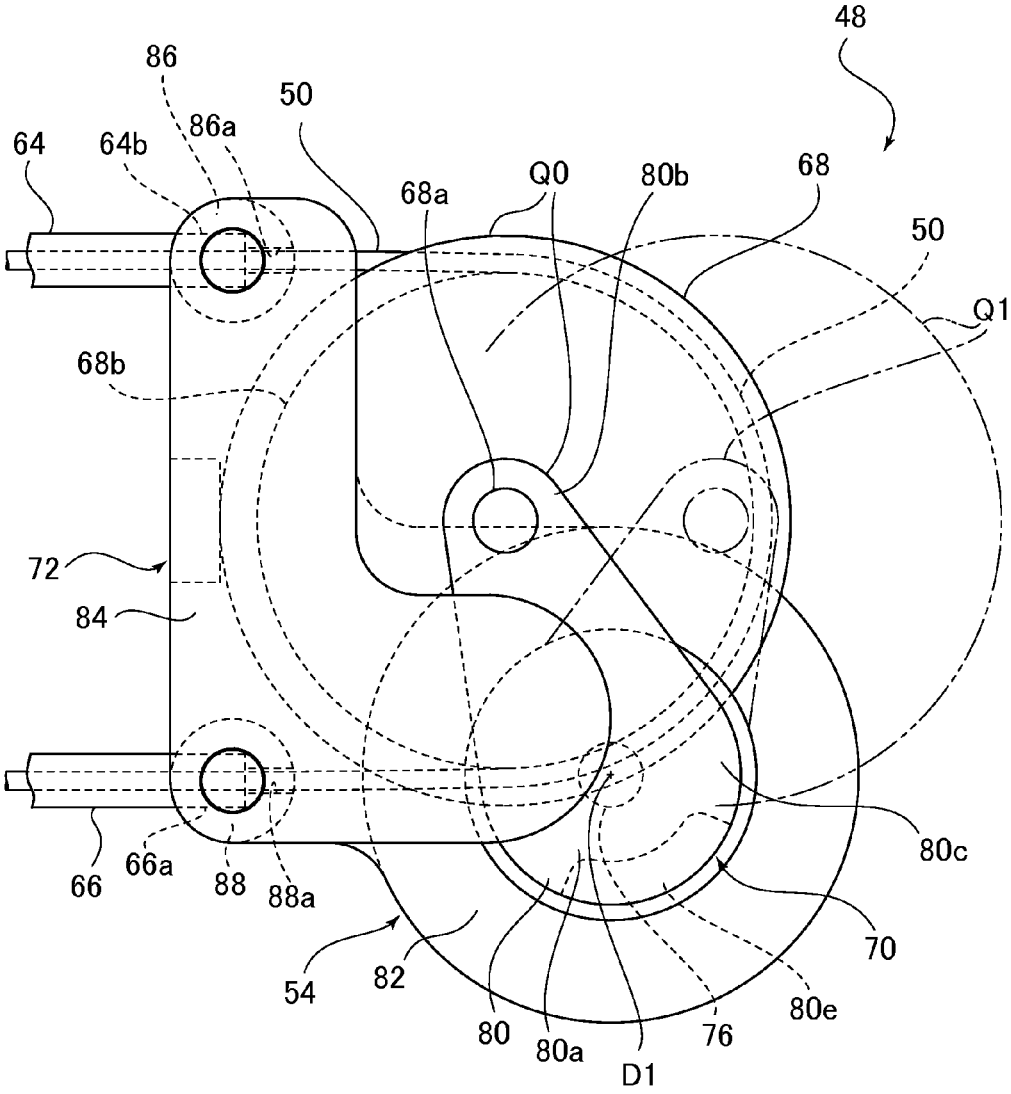
FIG. 4 is a front view of the operating device of the flush water tank device according to the first embodiment of the present invention.
Figure 5:
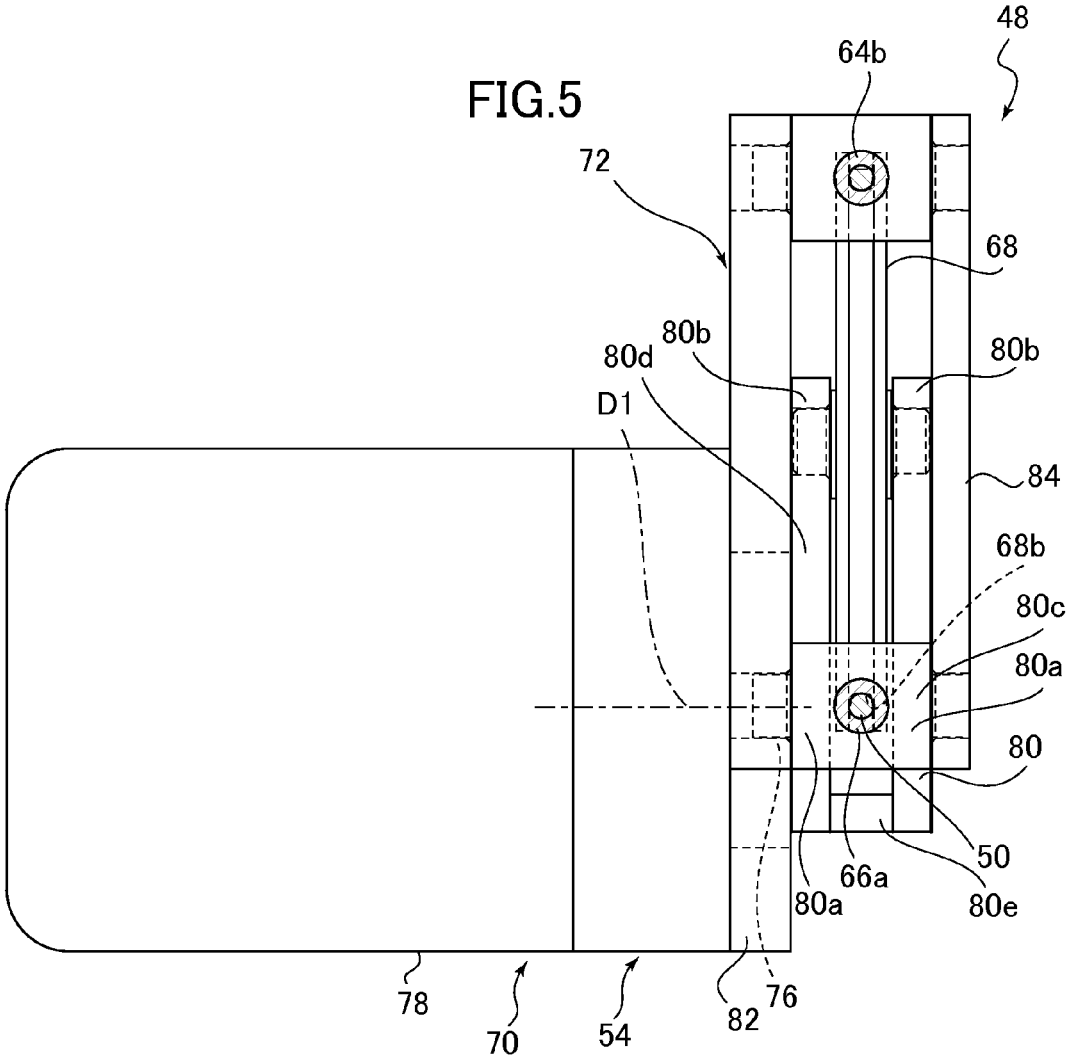
FIG. 5 is a side view of the operating device of the flush water tank device according to the first embodiment of the present invention.
Figure 6:
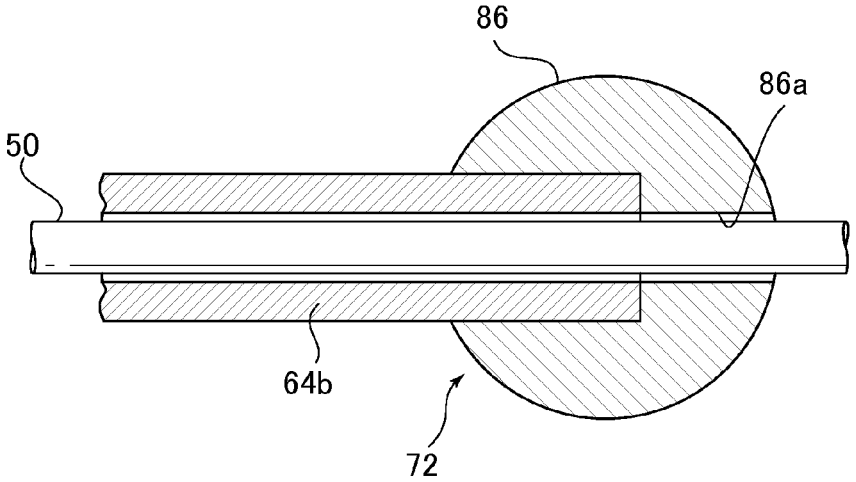
FIG. 6 is a cross-sectional view, partially enlarged, of a first tube holding portion in the operating device of the flush water tank device according to the first embodiment of the present invention, the first tube holding portion being shown to hold the second end of the first tubular member

With reference to FIGS. 4 to 6, the electrical drive unit of the operating device for the flush water tank device according to the first embodiment of the present invention will be described in detail.

FIG. 4 is a front view of the operating device of the flush water tank device according to the first embodiment of the present invention. FIG. 5 is a side view of the operating device of the flush water tank device according to the first embodiment of the present invention. FIG. 6 is a cross-sectional view, partially enlarged, of a first tube holding portion in the operating device of the flush water tank device according to the first embodiment of the present invention, the first tube holding portion being shown to hold the second end of the first tubular member.

The electrical drive unit 54 comprises a freely rotatable pulley 68, the outer periphery of which supports the single wire member 50 passing therearound, an electrical drive 70 for moving the pulley 68 by means of a power from an external power source, a support portion 72 supporting the first tubular member 64, the second tubular member 66 and the electrical drive 70, and a controller 74 for controlling the electrical drive unit 54 (see FIG. 1).

The pulley 68 is freely rotatable around the central pulley shaft 68*a*. The outer periphery 68*b* of the pulley 68 receives the wire member so that it extends around the outer periphery thereof. This outer periphery 68*b* is provided with a groove which can receive the wire member 50 in a stable manner. The pulley 68 is adapted to be freely rotatable with the free movement of the wire member 50 when the wire member 50 is moved toward the flush valve side or manually operating unit. Further, the pulley 68 can be moved by an arm member, which will be described later. At this time, the central pulley shaft 68*a* of the pulley 68 is moved away from the support portion 72 and also moved relative to the wire member 50.

As the central pulley shaft 68*a* of the pulley 68 is moved, the distance between the support portion 72 and the central pulley shaft 68*a* is increased in the electrical drive unit 54. Thus, the length of the wire member 50 within the electrical drive unit 54, that is, the length of the wire member 50 between first and second entry portions 86*a* and 88*a*, which will be described later, becomes equal to L3 in the stand-by position. On the contrary, the length of the wire member 50 becomes equal to L4 in the large-scale flushing operation (the portion of the wire member 50 along the outer periphery 68*b* of the pulley 68 in the large-scale flushing operation is indicated by an imaginary line R1) whereas the length of the wire member 50 becomes equal to L5 in the small-scale flushing operation (the portion of the wire member 50 along the outer periphery 68*b* of the pulley 68 in the small-scale flushing operation is indicated by an imaginary line R2). The relationship between the lengths of the wire member 50 within the electrical drive unit 54 can be represented by L3<L5<L4.

In such a manner, the pulley 68 can be freely rotated with the movement of the pulley 68 relative to the wire member 50 such that the wire member 50 will be pulled up gradually on the side of the water discharge valve device 24 while the pulley 68 will be moved to pull up the wire member 50.

The electrical drive 70 has a motor part 78 driving the rotary drive shaft 76 in rotation and an arm member 80 having one end 80*a* mounted on the rotary drive shaft 76 of the motor part 78 at a position adjacent to the motor, the other end 80*b* being mounted on the central shaft 68*a* of the pulley 68 at a position adjacent to the pulley. The electrical drive 70 drives the rotary drive shaft 76 of the motor part 78 in rotation to rotate the arm member 80 around the rotary drive shaft 76. As a result, the pulley 68 is moved.

The motor part 78 is configured to drive the motor through a gear unit (not shown) when the motor part is supplied with an electrical power from an external source for rotating the rotary drive shaft 76. However, the motor part 78 may be configured to rotatably drive the rotary drive shaft 76 in a direct manner. The motor part 78 is connected to an electrical drive unit control section 74 which controls to start and stop the rotation of the motor part 78. The motor part 78 may be located above the full level of water WL within the flush water tank 18.

The arm member 80 is configured in the shape of a upwardly opened C-shaped plate member to connect the rotary drive shaft 76 and the central pulley shaft 68*a*. The arm member 80 is provided at its base with a joint 80*e* connecting a forward arm portion 80*c* and a rearward art portion 80*d* on which the rotary drive shaft 76 of the motor part 78 is mounted. The motor side end portion 80*a* of the motor part 78 is rotatably mounted on the rotary drive shaft 76. The pulley side end portion 80*b* is mounted on the central pulley shaft 68*a* to support it in a rotatable manner. When the motor side end part 80*a* is rotated around the rotary drive shaft 76, the pulley side end portion 80*b* is transversely moved along an arc.

The support portion 72 is provided with a back wall portion 82 secured to the motor part 78, a front wall portion 84 cooperating with the back wall portion 82 to form a space in which the pulley 68 and the arm member 80 are rotatably disposed, a first tube holding portion 86 for holding the second end 64*b* of the first tubular member 64 at the upper region between the front and back wall portions 84 and 82, and a second tube holding portion 88 for holding the second end 66*b* of the first tubular member 66 at the lower region between the front and back wall portions 84 and 82.

The first tube holding portion 86 is provided with the first entry port portion 86*a* extending right to the back face of the first tube holding portion 86 opposed to the first tubular member 64 and which can guide the wire member 50 to the outer periphery of the pulley 68 in the electrical drive unit 54. The first tube holding portion 86 is configured to smoothly move and pass the wire member 50 in the first tubular member 64 through the first entry port portion 86*a* when the second end 64*b* of the first tubular member is in its holding position.

The second tube holding portion 88 is provided with the second entry port portion 88*a* extending right to the back face of the second tube holding portion 88 opposed to the second tubular member 66 and which can guide the wire member 50 to the outer periphery of the pulley 68 in the electrical drive unit 54. The second tube holding portion 88 is configured to smoothly move and pass the wire member 50 in the second tubular member 66 through the second entry port portion 88*a* when the second end 66*a* of the second tubular member is in its holding position.

The first tube holding portion 86 holds the second end 64*b* of the first tubular member such that the direction of opening in the second end 64*b* of the first tubular member 64 is directed to the upper portion of the pulley 68 and substantially corresponds to the direction of movement B1 of the pulley 68.

The second tube holding portion 88 holds the first end 66*a* of the second tubular member such that the direction of opening in the first end 64*b* of the second tubular member 64 is directed to the lower portion of the pulley 68 and substantially corresponds to the direction of movement B1 of the pulley 68.

The controller 74 controls the electrical drive unit 54 in response to a toilet bowl flushing start signal transmitted from an instruction device 90 which is used by the user to instruct the toilet bowl flushing operation (large-scale and small-scale flushing mode start operation) or a proximity sensor (not shown) for detecting the user's body standing before the toilet bowl.

As shown in FIG. 1, the electrical drive unit controller 74 is positioned on the outer right-side wall of the flush water tank 18. The instruction device 90 including a plurality of control buttons 90*a* for the user to instruct the initiation of the large-scale and small-scale flushing operation to the toilet main unit 2 is mounted on the wall adjacent to the flush toilet 1.

In the first embodiment of the present invention, the operating device of the flush water tank device for actuating the flush valve within the flush water tank to initiate the delivery of flush water to the toilet bowl may be provided by producing an operating device comprising a single connecting member, a manually operating unit and an electrical drive unit. Additionally, the operating device of the flush water tank device according to the first embodiment of the present invention may be configured (manufactured) relatively simply and easily for example, by retrofitting an electrical drive unit to the operating device of the existing flush water tank device including a single connecting member and a manually operating unit configured to move the single connecting member upwardly to actuate a flush valve.

With reference to FIGS. 1 to 7, the operating device of the flush water tank device according to the first embodiment of the present invention will now be described in operation (function).

Figure 7:
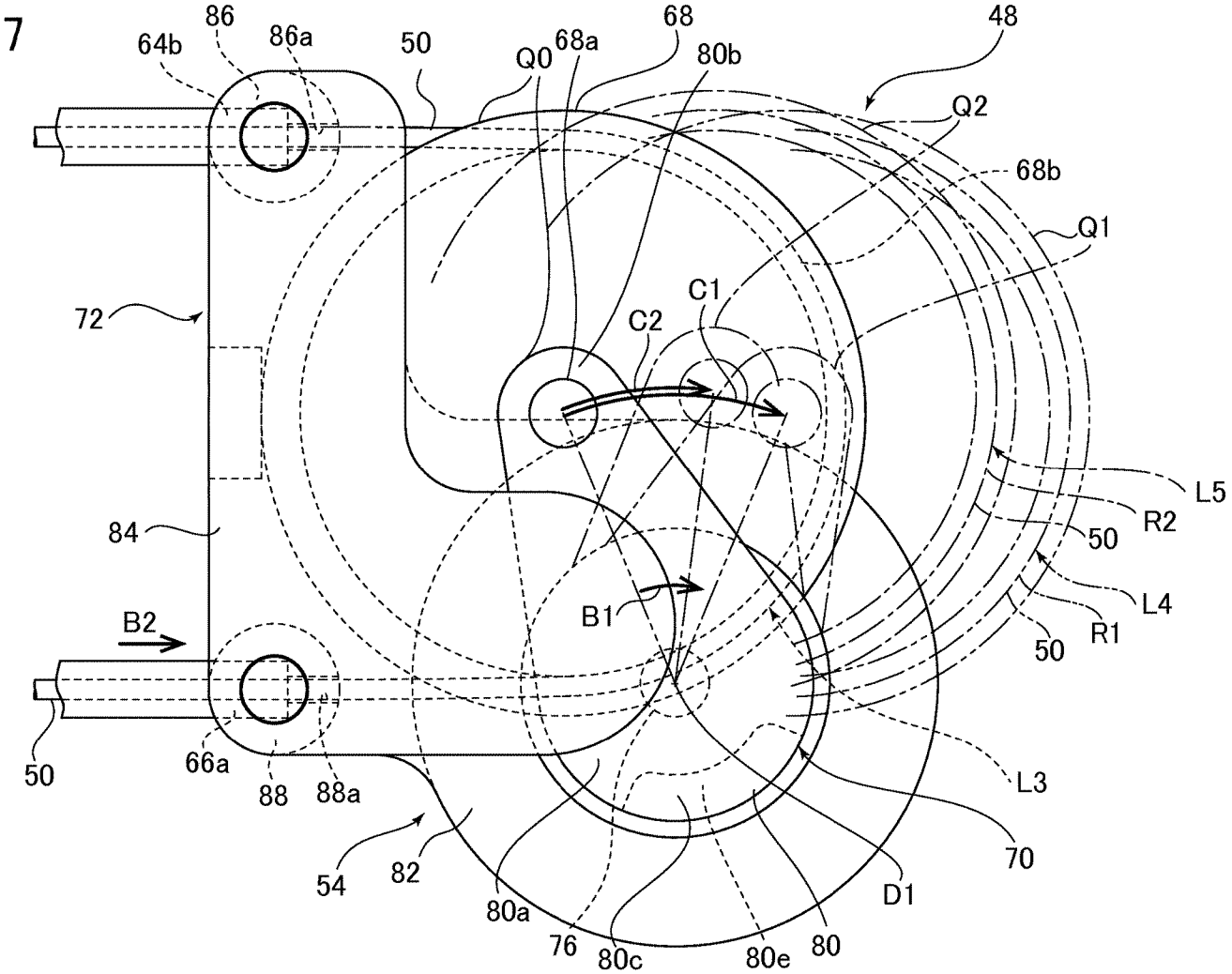
FIG. 7 is a front view of the operating device of the flush water tank device according to the first embodiment of the present invention, showing a stand-by state, a state wherein a pulley has been moved in the large-scale flushing mode and another state wherein the pulley has been moved in the small-scale flushing mode.

FIG. 7 is a front view of the operating device of the flush water tank device according to the first embodiment of the present invention, showing a stand-by state, a state wherein a pulley has been moved in the large-scale flushing mode and another state wherein the pulley has been moved in the small-scale flushing mode.

First of all, referring to FIGS. 1 to 7, in the flush water tank device including the operating device of the flush water tank device according to the first embodiment of the present invention and the flush toilet equipped with such a flush water tank device, the large-scale flushing mode to be performed by the manually operating unit 52 is explained below As can be seen in FIG. 2, the operating handle 62 is in its stand-by position before it begins to be operated by the user. In the manually operating unit 52, the rotary wind-up member 58 is in its stand-by position (initial position). The water discharge port 20 is closed by the valve body 40 connected to the wire member 50. At this time, the initial water-level in the flush water tank 18 is full-level WL (FIG. 3).

If it is desired to open the valve body 40 in a manual manner by using the manually operating unit 52 of the operating device 48 as the valve body 40 is in its closing (stand-by) position for closing the water discharge port 20 in the large-scale flushing mode, the user must rotate the manually operating handle 62 to a relatively large angle downwardly as shown by an arrow A1 in FIG. 2. Accordingly, the rotary wind-up member 58 is rotated around the rotating shaft member 60 in the direction of arrow A1. This causes the rotary wind-up member 58 to wind the end portion 50*b* of the wire member 50 adjacent to the manually operating unit around the outer periphery of the rotary wind-up member 58 as the rotary wind-up member 58 is being rotated. Therefore, the wire member 50 is pulled up by a predetermined length in the direction of arrow A2. The wire member 50 is pulled up while moving the path including the rectilinear and curved portions of the first tubular member 64 in the first tubular member 64.

In the electrical drive unit 54, the wire member 50 is moved up from the entry port portion 88*a* toward the first entry port portion 86*a* along the outer periphery 68*b* of the pulley 68. At this time, the electrical drive unit 54 is not actuated. Therefore, the outer periphery 68*b* of the pulley 68 is freely rotated with the motion of the wire member 50 while the central shaft 68*a* of the pulley 68 is held in its stand-by position. The wire member 50 is pulled up while moving the path including the rectilinear and curved portions of the second tubular member 66 in the second tubular member 66. In this manner, the valve stem 34 and the valve body 40 are moved up by upwardly moving the end 50*a* of the wire member 50 adjacent to the flush valve.

When the wire member 50 is pulled up by a predetermined relatively large length in the large-scale flushing mode, the valve body 40 is moved upwardly to a predetermined relatively high position wherein the flush valve is opened. Consequently, a relatively large volume of flush water in the flush water tank 18 is discharged through the water discharge port 20 toward the second water conduit (not shown) of the toilet main unit 2 to initiate the large-scale flushing mode.

When the wire member 50 is move up to locate the valve body 40 in its open position and if the user releases the operating handle 62, a return spring (not shown) rotates the operating handle 62 to its initial and stand-by position to move the valve body 40 downwardly to its close position wherein the water discharge port 20 is closed. This is the original position.

Referring again to FIGS. 1 to 7, in the flush water tank device including the operating device of the flush water tank device according to the first embodiment of the present invention and the flush toilet equipped with such a flush water tank device, the small-scale flushing mode to be performed by the manually operating unit 52 is explained below.

Since the operation of the wire member 50 in the small-scale flushing mode performed by the manually operating unit 52 is different from the operation of the wire member 50 in the large-scale flushing mode only in that the pull-up amount of the wire member 50 is decreased, similar parts will not be further described below.

When the user rotates the manually operating handle 62 downwardly to a relatively small angle in the small-scale flushing mode, the rotary wind-up member 58 is rotated around the rotating shaft member 60 in the direction of arrow A1. This causes the rotary wind-up member 58 to wind the end portion 50*b* of the wire member 50 adjacent to the manually operating unit around the outer periphery of the rotary wind-up member 58 as the rotary wind-up member 58 is being rotated. Therefore, the wire member 50 is pulled up by a predetermined length in the direction of arrow A2.

In the electrical drive unit 54, the wire member 50 is moved up from the entry port portion 88*a* toward the first entry port portion 86*a* along the outer periphery 68*b* of the pulley 68. The pull-up amount of the wire member 50 in the small-scale flushing mode is smaller than the pull-up amount of the wire member 50 in the large-scale flushing mode. At this time, the electrical drive unit 54 is not actuated. Therefore, the outer periphery 68*b* of the pulley 68 is freely rotated with the motion of the wire member 50 while the central shaft 68*a* of the pulley 68 is held in its stand-by position. In this manner, the valve stem 34 and the valve body 40 are moved up by upwardly moving the end 50*a* of the wire member 50 adjacent to the flush valve.

When the wire member 50 is pulled up by a predetermined relatively small length in the small-scale flushing mode, the valve body 40 is moved upwardly to a predetermined relatively high position wherein the valve is opened. Consequently, a relatively small volume of flush water in the flush water tank 18 is discharged through the water discharge port 20 toward the water conduit (not shown) of the toilet main unit 2 to initiate the small-scale flushing mode.

Still again, referring to FIGS. 1 to 7, in the flush water tank device including the operating device of the flush water tank device according to the first embodiment of the present invention and the flush toilet equipped with such a flush water tank device, the large-scale flushing mode to be performed by the electrical drive unit 54 is explained below.

It is to be noted herein that the stand-by position Q0 of the arm member 80 and pulley 68 of the electrical drive unit 54 are shown by solid line in the FIG. 7. The respective positions Q1 and Q2 of maximum movement in the arm member 80 and pulley 68 in the large-scale and small-scale flushing modes are shown by chain-dotted line.

If it is desired to move the valve body 40 from a position in which it closes the water discharge port 20 (stand-by position) to another position in which the valve body 40 is electrically moved to open the valve by the electrical drive unit 54, the user depresses a predetermined control button (not shown) in the external instruction device (not shown) to instruct a toilet bowl flushing operation. Alternatively, a proximity sensor (not shown) detects the user's body standing before the toilet bowl. The resulting signals are transmitted to the electrical drive unit controller 74 which in turn instructs and actuates the motor part 78 of the electrical drive unit 54. As a result, the rotary drive shaft 76 is rotated around a central axis of rotation D1 to a predetermined angle of rotation (e.g., approximately 45 degrees) in the direction of rotation as shown by arrow B1 in FIG. 7. Consequently, the end 80*b* of the arm member 80 adjacent to the pulley is rotated from the stand-by position Q0 through a predetermined angle of rotation (e.g., approximately 45 degrees) in the direction of rotation as shown by arrow B1 to move the central pulley shaft 68*a* through a predetermined movement along such an arc as shown by arrow C1. The central pulley shaft 68*a* is moved apart from the first and second entry port portions 86*a* and 88*a* and will be moved to the maximum movement position Q1 as the pulley 68 is moved furthest.

The wire member 50 is pulled up in the electrical drive unit 54 with the transverse movement of the central pulley shaft 68*a* or with the movement of the whole pulley 68. The wire member 50 is rolled up into the electrical drive unit 54 through the second entry port portion 88*a* as the whole pulley 68 is moved in the direction of arrow B2. Although the length of the wire member 50 within the electrical drive unit 54 is L3 in the stand-by state, the length of the wire member 50 within the electrical drive unit 54 becomes L4 as the whole pulley 68 is moved in the large-scale flushing mode. Since the length L1 of the first tubular member 64 and the length L2 of the second tubular member 66 are invariable relative to the length of the wire member 50, the valve body 40 connected to the wire member 50 will be moved upwardly by the increased length (=L4−L3) of the wire member 50 within the electrical drive unit 54.

Since the manually operating unit 52 is in its inoperative position, the wire member 50 remains at a position between the manually operating unit 52 and the electrical drive unit 54. Therefore, the wire member 50 is pulled up toward the water discharge valve device 24 through the second entry port portion 88*a* since the portion of the wire member 50 between the first entry port portion 86*a* and the manually operating unit 52 is not movable.

Accordingly, the single wire member 50 can be pulled up by an amount required in the large-scale flushing mode by moving the pulley 68 located on the mid part of the single wire member 50.

In the electrical drive unit 54, the wire member 50 is pulled up through the second entry port portion 88*a* toward the outer periphery 68*b* of the pulley 68 as shown by arrow B2. Therefore, the wire member 50 is pulled up while moving the path including the rectilinear and curved portions of the second tubular member 66 through the second tubular member 66. In this manner, the valve stem 34 and the valve body 40 are moved up by upwardly moving the end 50*a* of the wire member 50 adjacent to the flush valve.

When the wire member 50 is pulled up by a predetermined relatively large length in the large-scale flushing mode, the valve body 40 is moved upwardly to a predetermined relatively high position wherein the valve is opened. Consequently, a relatively large volume of flush water in the flush water tank 18 is discharged through the water discharge port 20 toward the second water conduit (not shown) of the toilet main unit 2 to initiate the large-scale flushing mode.

When the wire member 50 is pulled up to move the valve body 40 to its open position and if a predetermined period of time preset depending on the large-scale flushing mode has passed, the controller 74 of the electrical drive unit generates and sends a command to the motor part 78 which is in turns driven reversely to the rotary drive shaft 76 to its stand-by position. As a result, the end part 80*b* of the arm member 80 and the pulley 68 are retuned in rotation from the maximum movement position Q1 to the stand-by position Q0. The pulled-up portion of the wire member 50 is again pulled out toward the valve stem 34 so that the length of the portion of the wire member 50 within the electrical drive unit 54 becomes equal to L3. Thus, the valve body 40 is lowered to its original position to close the water discharge port 20.

Still again, referring to FIGS. 1 to 7, in the flush water tank device comprising the operating device of the flush water tank device according to the first embodiment of the present invention and the flush toilet equipped with such a flush water tank device, the small-scale flushing mode to be performed by the electrical drive unit 54 is explained below.

When the valve body 40 is in a position in which the water discharge port 20 is closed (stand-by position) and if the valve body 40 is moved to open the water discharge port 20 through the actuation of the electrical drive unit 54, the controller 74 of the electrical drive unit generates a command for actuating the motor 78 of the electrical drive unit 54. Thus, the rotary drive shaft 76 is rotated around the center axis of rotation D1 to a predetermined angle of rotation (e.g., approximately 30 degrees) in the direction of rotation as shown by arrow B1 in FIG. 7. Therefore, the end 80*b* of the arm member 80 adjacent to the pulley is swung from the stand-by position Q0 to a predetermined angle of rotation (e.g., approximately 30 degrees) in the direction of rotation as shown by arrow B1. As a result, the central pulley shaft 68*a* is moved by a predetermined movement along an arc as shown by arrow C2. The movement C2 of the central pulley shaft 68*a* in the small-scale flushing mode becomes smaller than the movement C1 of the central pulley shaft 68*a* in the large-scale flushing mode. If the central pulley shaft 68*a* is moved apart from the first and second entry port portions 86*a* and 88*a* to move the pulley 68 farthest, the pulley 68 will be moved to its maximum movement position Q2.

The wire member 50 is pulled up within the electrical drive unit 54 with the transverse movement of the central pulley shaft 68*a* or the movement of the whole pulley 68. In response to the movement C2 of the whole pulley 68 in the direction of arrow B1, the wire member 50 is rolled up within the electrical drive unit 54 through the second entry port portion 88*a*. In the stand-by state, the length of the portion of the wire member 50 existing within the electrical drive unit 54 becomes equal to L3. On the contrary, the length of the portion of the wire member 50 existing within the electrical drive unit 54 becomes equal to L5 in the small-scale flushing mode since the whole pulley 68 is moved. Since the length L1 of the first tubular member 64 and the length L2 of the second tubular member 66 are invariable relative to the length of the wire member 50, the valve body 40 connected to the wire member 50 will be moved upwardly by the increased length (=L5−L3) of the wire member 50 within the electrical drive unit 54.

Since the manually operating unit 52 is in its inoperative position, the wire member 50 remains at a position between the manually operating unit 52 and the electrical drive unit 54. Therefore, the wire member 50 is pulled up toward the water discharge valve device 24 through the second entry port portion 88*a* since the portion of the wire member 50 between the first entry port portion 86*a* and the manually operating unit 52 is not movable.

Accordingly, the single wire member 50 can be pulled up by an amount required in the small-scale flushing mode by moving the pulley 68 located on the middle part of the single wire member 50.

Wire member 50 is raised in electrical drive unit 54 towards outer periphery portion 68*b* of pulley 68 as shown in arrow B2 by second entry port portion 88*a*.

In this manner, the valve stem 34 and the valve body 40 are moved up by upwardly moving the end 50*a* of the wire member 50 adjacent to the flush valve.

When the wire member 50 is pulled up by a predetermined relatively short length in the large-scale flushing mode, the valve body 40 is moved upwardly to a predetermined relatively low position wherein the valve is opened. Consequently, a relatively small volume of flush water in the flush water tank 18 is discharged through the water discharge port 20 toward the second water conduit (not shown) of the toilet main unit 2 to initiate the large-scale flushing mode.

When the wire member 50 is pulled up to move the valve body 40 to its open position and if a predetermined period of time preset depending on the small-scale flushing mode has passed, the controller 74 of the electrical drive unit generates and sends a command to the motor part 78 which is in turns driven reversely to the rotary drive shaft 76 to its stand-by position. As a result, the end part 80*b* of the arm member 80 and the pulley 68 are retuned in rotation from the maximum movement position Q2 to the stand-by position Q0. The pulled-up portion of the wire member 50 is again pulled out toward the valve stem 34 so that the length of the portion of the wire member 50 within the electrical drive unit 54 becomes equal to L3. Thus, the valve body 40 is lowered to its original position to close the water discharge port 20.

In the operating device 48 of the flush water tank device according to the first embodiment of the present invention, each of the manually operating unit 52 and the electrical drive unit 54 (that is, the respective one of the manually operating unit 52 or the electrical drive unit 54) can actuate the valve body 40 through the single wire member 50. In the operating device 48 of the flush water tank device 16 utilizing the single wire member 50 and the valve body 40 operatively connected with the single wire member 50, therefore, the user can actuate the flush valve body 40 not only manually but also electrically. This improves the ease-to-use with respect to the operating device 48 of the flush water tank device 16.

In the operating device 48 of the flush water tank device according to the first embodiment of the present invention, the manually operating unit 52 can actuate the valve body 40 by manually rotating it to pull up the wire member 50. Additionally, the electrical drive unit 54 can move the pulley 68 through the externally powered electrical drive 70 to pull up the single wire member 50 and to actuate the valve body 40.

Thus, each of the manually operating unit 52 and the electrical drive unit 54 can actuate the valve body 40 through the single wire member 50. In the operating device 48 of the flush water tank device 16 utilizing the single wire member 50 and the valve body 40 operatively connected with the single wire member 50, therefore, the user can actuate the flush valve body 40 not only manually but also electrically. This improves the user's ease-to-use in connection with the operating device 48 of the flush water tank device 16.

In the operating device of the flush water tank device according to the first embodiment of the present invention 48, the electrical drive 70 of the electrical drive unit 54 can move the pulley 68 by means of a relatively simple structure.

In the operating device 48 of the flush water tank device according to the first embodiment of the present invention, furthermore, the wire member 50 can be pulled up along the configuration of the first and second tubular members 64 and 66 between the electrical drive unit 54, the manually operating unit 52 and the valve body 40. Therefore, it is not required to make the wire member stretched always in taut between the electrical drive unit, the flush valve and the manually operating unit as in the prior art which does not comprise a tubular member. Accordingly, the electrical drive unit 54 can be positioned in an unconstrained manner within the flush water tank 18 unlike the prior art which does not comprise the first and second tubular members 64 and 66.

In the operating device 48 of the flush water tank device according to the first embodiment of the present invention, furthermore, the first tube holding portion 86 holds the second end 64*b* of the first tubular member while the second tube holding portion 88 holds the first end 66*a* of the second tubular member. When the pulley 68 is moved, therefore, the wire member 50 can be appropriately pulled from the interior of the second tubular member 66 into the interior of the electrical drive unit 54. In such a manner, the pull-up amount of the wire member 50 can be controlled into a preset level which corresponds to the movement of the pulley 68. Consequently, the upward movement of the valve body 40 can be controlled relatively exactly to reduce any variation in the upward movement of the valve body 40.

In the operating device 48 of the flush water tank device according to the first embodiment of the present invention, furthermore, the pull-up amount of the wire member 50 relative to the upward movement of the pulley 68 can be substantially maximized. When the pulley 68 is moved, the wire member 50 can be effectively pulled from the interior of the second tubular member 66 into the interior of the electrical drive unit 54.

In the operating device 48 of the flush water tank device according to the first embodiment of the present invention, furthermore, the electrical drive 70 can be protected against failure due to a possible ingress of the water into the electrical device. Accordingly, the electrical drive unit 54 can appropriately move the wire member 50 upwardly to actuate the valve body 40.

In the operating device 48 of the flush water tank device according to the first embodiment of the present invention, furthermore, the electrical drive unit 54 can change the angle of rotation of the arm member 80 between the first angle of rotation and the second angle of rotation which is smaller than the first angle of rotation to change the movement of the pulley 68 and also the pull-up amount of the wire member 50. As a result, the pull-up amount of the wire member 50 can be changed between the pull-up amount of the valve body 40 in the large-scale flushing mode and the pull-up amount of the valve body 40 in the small-scale flushing mode. Consequently, the electrical drive unit 54 can change between the large-scale flushing mode and the small-scale flushing mode.

Additionally, the present invention provides the flush water tank device 16 comprising the aforementioned operating device 48.

With such arrangement of the present invention, there can be provided a flush water tank device 16 in which each of the manually operating unit 52 and the electrical drive unit 54 can actuate the valve body 40 through the single wire member 50.

Additionally, the present invention provides the flush toilet 1 equipped with the aforementioned flush water tank device 16.

With such arrangement of the present invention, there can be provided a flush toilet 1 equipped with the flush water tank device 16 which includes the operating device 48.

An operating device for a flush water tank device according to the second embodiment of the present invention will now be described.

The operating device of the flush water tank device according to the second embodiment of the present invention is different from the operating device 30 of the flush water tank device according to the first embodiment of the present invention only in that the electrical drive unit 54 in the first embodiment is changed to a manually operating unit and the manually operating unit 52 in the first embodiment is changed to the electrical unit.

Only the components of the operating device of the flush water tank device according to the second embodiment of the present invention which are different from those of the first embodiment of the present invention, are described below. The same components of the second embodiment of the present invention as those of the first embodiment are designated by the same reference numerals and not be further described. The flush water tank device including the operating device according to the second embodiment of the present invention and the flush toilet equipped with the above flush water tank device are the same as those of the first embodiment of the present invention. Thus, they will not be described further.

The operating device 48 according to the second embodiment of the present invention comprises an electrical drive unit for electrically pulling up the wire member 50 via an electrically driven motor, and a manually operating unit for manually pulling up the wire member 50, unlike the first embodiment of the present invention. This operating device 48 comprises a single wire member 50 which connects the electrically-drive unit and the valve stem 34 through the manually operating unit.

The electrically-drive unit is configured to rotate the rotary wind-up member 58 through a motor and a gear unit which are electrically powered. The rotary wind-up member 58 is electrically driven in in a predetermined direction of rotation to pull up the wire member 50. Dependent on the direction of rotation and/or the amount of rotation in the rotary wind-up member 58, the electrical drive unit causes the large-scale flushing mode to execute if the amount of rotation in the rotary wind-up member 58 (e.g., the pull-up amount in the wire member 50 mounted to the rotary wind-up member 58) is relatively large or the small-scale flushing mode to execute if the amount of rotation in the rotary wind-up member 58 (e.g., the pull-up amount in the wire member 50 mounted to the rotary wind-up member 58) is relatively small.

The manually operating unit comprises a freely rotatable pulley 68 having an outer periphery round which the single wire member 50 passes, the single wire member 50 being along the outer periphery, a drive which moves the pulley 68 when the drive is operated by the user, and a support portion 72 supporting the first tubular member 64, the second tubular member 66 and the drive. In such a manner, the relative movement of the pulley 68 to the wire member 50 causes the pulley 68 to rotate freely to thereby move the wire member 50 upwardly while winding up the wire member 50 connecting with the water discharge valve device 24.

The drive has an operating handle outwardly extending through the flush water tank 18 and driving the drive in rotation, and an arm member 80 mounted on the rotary drive shaft of the operating handle, the pulley end 80 of the arm member being mounted on the central pulley shaft 68*a* of the pulley 68. When the rotary drive shaft of the operating handle is rotatably driven, the arm member 80 is also rotated on the rotary drive shaft to move the pulley 68. The operating handle is configured to drive the rotary drive shaft 76 in rotation when it is manually rotated by the user.

The arm member 80 is connected at its rearward portion to a rotary drive shaft. When the motor end 80*a* of the arm member 80 is rotated on the rotary drive shaft, the pulley end 80*b* of the arm member 80 is moved along an arc. The support portion 72 is provided with a back wall portion 82 which is fastened to the drive.

The electrical drive unit comprises a controller which can actuate the above-mentioned electrical unit in response to a toilet bowl flushing start command transmitted from an instruction device 90 in which the user can instructs a toilet bowl flushing operation (a large-scale flushing mode start operation or a small-scale flushing mode start operation) or from a proximity sensor (not shown) for detecting the presence of the user.

In the operating device of the flush water tank device according to the second embodiment of the present invention, each of the manually operating unit and the electrical drive unit can actuate the valve body 40 via the single wire member 50. Consequently, in the operating device of the flush water tank device utilizing the single wire member 50 for actuating the valve body 40, the valve body 40 can be not only manually operated, but also actuated based on an electric power from an external source. This improves the usability for the operating device of the flush water tank device.

What is claimed is:

1. An operating device for a flush water tank device adapted to actuate a flush valve disposed in a flush water tank so as to initiate delivery of flush water to a toilet main unit, comprising:

a single connecting member operatively connected to the flush valve for opening and closing the flush valve depending on a travel amount of the connecting member;

a manually operating unit provided on the flush water tank and actuating the flush valve by pulling up the single connecting member as a user performs a manual rotary operation; and an electrical drive unit adapted to pull up the single connecting member so as to actuate the flush valve by using an electrical power from an external power source, wherein one end of the single connecting member is connected to the flush valve, while an other end of the single connecting member is connected to the manually operating unit via the electrical drive unit, or while the other end of the single connecting member is connected to the electrical drive unit through the manually operating unit.

2. The operating device according to claim 1, wherein the single connecting member is configured to operate and close depending on the travel amount of the connecting member;

the other end of the single connecting member is connected via the electrical drive unit to the manually operating unit provided on the flush water tank such that the manually operating unit can pull up the single connecting member as the user performs the manual rotary operation for the manually operating unit to thereby actuate the flush valve; and the electrical drive unit comprises a rotating mechanism adapted to be rotated freely with the single connecting member being along an outer periphery of the rotating mechanism and an electrical drive for moving the rotating mechanism by using an electrical power from an external power source, the movement of the rotating mechanism causing the single connecting member to be pulled up to actuate the flush valve.

3. The operating device according to claim 2, the electrical drive of the electrical drive unit is positioned above a full level of water pooled within the flush water tank.

4. The operating device according to claim 2, wherein the electrical drive of the electrical drive unit comprises a motor part for driving a rotary shaft of the motor part and an arm member having one of ends connected to the rotary shaft of the motor part and the other end connected to the rotating mechanism, the rotation of the rotary shaft of the motor part causing the arm member to rotate about the rotary shaft to thereby providing the movement of the rotating mechanism.

5. The operating device according to claim 4, wherein the electrical drive unit can change an angle of rotation of the arm member between a first angle of rotation and a second angle of rotation which is smaller than the first angle of rotation so as to change the pull-up amount of the connecting member between a pull-up amount of the flush valve of a large-scale flushing mode and a pull-up amount of the flush valve of a small-scale flushing mode of the flush water tank device.

6. The operating device according to claim 2, further comprising:

tubular members extending between the electrical drive unit, the manually operating unit and the flush valve respectively and the single connecting member passes in an interior of the tubular members;

the tubular members being attached to the electrical drive unit and positioned with the single connecting member being exposed from the tubular members within the electrical drive unit, the movement of the rotating mechanism causing the single connecting member to be pulled out of the interior of the tubular members into the interior of the electrical drive unit to thereby pull up the single connecting member.

7. The operating device according to claim 6, wherein the electrical drive unit further comprises tube holding portions holding one end of the tubular member.

8. The operating device according to claim 7, wherein the tube holding portions of the electrical drive unit holds the one end of tubular member so that the direction of movement of the rotating mechanism substantially corresponds to the direction in which the single connecting member is pull out into the interior of the electrical drive unit.

9. A flush water tank device including an operating device according to claim 1.

10. A flush toilet equipped with a flush water tank device according to claim 9.

* * * * *